US008215045B2

(12) United States Patent
Mitchell

(10) Patent No.: US 8,215,045 B2
(45) Date of Patent: Jul. 10, 2012

(54) ASSAULT RIFLE BUTTSTOCK AIMING AND STABILIZATION SYSTEM

(76) Inventor: Alex Rowley Mitchell, Lindon, UT (US)

( * ) Notice: Subject to any disclaimer, the term of this patent is extended or adjusted under 35 U.S.C. 154(b) by 158 days.

(21) Appl. No.: 12/577,184

(22) Filed: Oct. 11, 2009

(65) Prior Publication Data

US 2011/0083353 A1 Apr. 14, 2011

(51) Int. Cl.
*F41C 23/00* (2006.01)

(52) U.S. Cl. ..... 42/71.01; 42/72; 42/85; 42/94; 89/37.04

(58) Field of Classification Search ..... 42/71.01, 42/72, 74, 94, 90, 85, 106; 89/37.04; 224/149; 2/94, 115; 248/314
See application file for complete search history.

(56) References Cited

U.S. PATENT DOCUMENTS

| | | | | | |
|---|---|---|---|---|---|
| 476,246 | A * | 6/1892 | Burgess | 42/21 |
| 1,468,354 | A * | 9/1923 | Caretto | 42/74 |
| 1,497,794 | A * | 6/1924 | Saunders | 42/94 |
| 1,519,123 | A * | 12/1924 | Edwards | 2/94 |
| 3,708,801 | A * | 1/1973 | Davis | 2/94 |
| 4,243,165 | A * | 1/1981 | Schuler | 224/149 |
| 5,161,815 | A * | 11/1992 | Penor, Jr. | 280/477 |
| 5,528,846 | A * | 6/1996 | Baggett | 42/94 |
| 6,698,963 | B1 * | 3/2004 | Parker et al. | 403/130 |
| 6,732,466 | B2 * | 5/2004 | Bentley | 42/74 |
| 7,506,470 | B2 * | 3/2009 | Pereksta | 42/94 |
| 2007/0253764 | A1 * | 11/2007 | Clayton et al. | 403/122 |

FOREIGN PATENT DOCUMENTS

WO WO 2005079352 A2 * 9/2005

* cited by examiner

*Primary Examiner* — Gabriel Klein
(74) *Attorney, Agent, or Firm* — Angus C. Fox, III

(57) ABSTRACT

A buttstock shoulder stabilizer includes a locator ball having a radially-projecting threaded cylindrical stud that screws into the sling mount of the buttstock endplate of assault rifles, and a socket assembly that mounts on a soldiers flak jacket near his shoulder. The ball can be machined from a structural metal or made of thermoplastic injection molded about the cylindrical stud. The socket assembly has an oblong horizontally-disposed socket connected to a lower approach ramp. A wall surrounds upper and side portions of the socket and the side edges of the approach ramp. When the soldier brings his weapon to firing position, the ball slides up the access ramp an into the oblong socket. The socket assembly is preferably injection molded from a tough structural thermoplastic resin. The socket assembly is provided with slots which enable it to be strapped to a soldiers flak jacket near his shoulder.

19 Claims, 14 Drawing Sheets

ASSAULT RIFLE BUTTSTOCK AIMING AND STABILIZATION SYSTEM

BACKGROUND OF THE INVENTION

1. Field of the Invention

The present invention relates, generally, to rifle buttstock stabilization devices and, more particularly, to devices designed to enhance repeatability, uniformity and stability associated with aiming and discharging shoulder-fired rifles.

2. History of the Prior Art

An assault rifle is a gas-operated rifle designed for combat that can be selectively fired in both fully-automatic and semi-automatic modes. Assault rifles are the standard infantry weapons in most modern armies, having largely superseded or supplemented larger and more powerful battle rifles such as the M14, FN FAL and the Heckler & Koch G3. Examples of assault rifles include the AK-47, the M16, the M4 and the Steyr AUG.

The German military developed the assault rifle concept during World War II, based upon research that showed that most firefights happen at a range of less than 300 meters. The power and range of contemporary rifle cartridges was excessive for most small arms firefights. As a result, the German military sought a cartridge and rifle combining submachine gun features (large-capacity magazine, selective-fire) with an intermediate-power cartridge effective to 300 meters. To reduce manufacturing costs, the 7.92×57 mm Mauser cartridge case was shortened, the result of which was the lighter 7.92×33 mm Kurz (short). The Sturmgewehr model 1944 (storm rifle model 1944, usually abbreviated StG 44), is generally considered by historians to be the first modern assault rifle. Developed in Nazi Germany toward the end of World War II, it was the first of its kind to see major deployment. Though derided by the allied forces for its heavy receiver and fully-automatic fire capability, the StG44 fulfilled its role admirably, particularly on the Eastern Front, by offering greatly-increased concentration of fire, as compared to standard infantry rifles then in use. Fortunately, it arrived too late to have a significant effect on the outcome of the war.

Mikhail Kalashnikov began his career as a weapon designer while in a hospital after being wounded during the rout of Soviet troops by the German forces at the Battle of Bryansk. While recovering from his injuries, Kalashnikov experienced repeated flashbacks of the battle, and became obsessed with creating a submachine gun that would drive the Germans from his homeland. After tinkering with a submachine gun design for some time, he entered a 1944 competition for a new weapon that would chamber the 7.62×41 mm cartridge developed by Elisarov and Semin in 1943. A particular requirement of the competition was that the firearm be serviceable and reliable in the muddy, wet, and frozen conditions of the Soviet frontline. The Kalashnikov entry—a carbine bearing a strong design resemblance to the American M1 Garand—lost out to a Simonov design that would later become the SKS semi-automatic carbine. However, in response to a subsequent design competition in 1946, Kalashnikov and his design team submitted a redesign of his original carbine. The gas-operated rifle which his team entered is most aptly described as a hybrid of the best rifle technology of the period. His design incorporated the trigger, double locking lugs and unlocking raceway of the M1 Garand/M1 carbine; the safety mechanism of the Browning-designed Remington Model 8 rifle; and the gas system and layout of the StG44. Sixty years after its acceptance by the Soviet military in 1947, the iconic Avtomat Kalashnikova Model 1947 (shortened to AK-47) remains the most widely-used assault rifle in the world. More AK-type rifles have been produced than all other assault rifles combined. The main advantages of the Kalashnikov rifle are its simple design, fairly compact size and adaptability to mass production. It is inexpensive to manufacture, and easy to clean and maintain. In addition, its ruggedness and reliability are legendary. The large gas piston, generous clearances between moving parts, and tapered cartridge case design allow the gun to endure large amounts of foreign matter and fouling without failing to cycle. However, this reliability comes at the cost of accuracy, as the looser tolerances do not allow for precision and consistency.

The M14 rifle is an American selective-fire automatic rifle that chambers 7.62×51 mm NATO ammunition. It was the standard issue US rifle until 1970. The M14 was used for US Army and Marine Corps basic and advanced individual training, and was the standard issue infantry rifle in CONUS, Europe, and South Korea, until replaced by the M16 rifle in 1970. It remains in limited front line service with the United States Army, Marine Corps, Navy, and Air Force, and remains in use as a ceremonial weapon. It was the last so-called "battle rifle" (a term applied to weapons firing full-power rifle ammunition) issued in quantity to U.S. troops. The M14 was developed from a long line of experimental weapons based upon the M1 Garand, the first successful semi-automatic rifle to be put into active military service. Designed by Canadian-born John C. Garand while employed as a consulting engineer by the U.S. Springfield Armory, the M1 was standard issue for U.S. soldiers during World War II. Though among the most advanced infantry rifles of the 1940s, it was not a perfect weapon. It primary detractions were its length, its mass, its heavy ammunition, and its lack of a fully-automatic mode. Toward the end of the war, modifications were made to the basic design which addressed the final detraction. Those modifications included the incorporation of fully-automatic firing capability and replacing the 8-round "en bloc" clips with a detachable box magazine holding 20 rounds. John Garand's T20 conversion was the most widely-used of the fully-auto M1 variants. However, it soon became evident that the size and weight attributes of the basic M1 design required a more radical approach. Earle Harvey and Lloyd Corbett, both employees of the Springfield Armory, were instrumental in designing rifles for the new .30 Light Rifle cartridge, which was based upon .30-06 cartridge case cut down to the length of the .300 Savage case. The .30 Light Rifle eventually evolved into the 7.62×51 mm NATO and the commercial .308 Winchester round. Although shorter than the .30-06, the 7.62×51 mm NATO round retained the same power due to the use of modern propellants. Harvey was instrumental in designing a completely new T25 rifle prototype, while Corbett was tasked with developing .30 Light Rifle conversions of the M1 and T20 designs. Corbett's original T44 prototype used a T20 receiver rebarreled for the NATO 7.62 mm round. In addition, the long operating rod/piston of the M1 was replaced with the T25's shorter "gas expansion and cut-off" system. The T44 design evolved to use newly-fabricated receivers that were shorter than those of either the M1 or T20. The new action's length was matched to the shorter 7.62 mm NATO cartridge instead of the longer .30-06. Corbett's more conservative approach ultimately prevailed during design competitions that began in 1954, and the T44 was adopted by the U.S. military as the M14 in 1957. Springfield Armory began tooling a new production line in 1958 and delivered the first service rifles to the U.S. Army in July 1959.

Acceptance of the M14 did not occur before a radical newcomer entered the contest. In 1954, Eugene M. Stoner became chief engineer of newly-formed ArmaLite, a division of Fairchild Engine & Airplane Corporation. Stoner was primarily responsible for the development of 7.62 mm AR-10.

Springfield's T44 and similar entries were conventional rifles that used wood for the buttstock and which were built entirely of steel using mostly forged and machined parts. ArmaLite was founded specifically to bring the latest in designs and alloys to firearms design, and Stoner felt he could easily beat the other offerings. Stoner's AR-10 was radical for its day. The receiver was made of forged and milled aluminum alloy instead of steel. The barrel was mated to the receiver by a separate hardened steel extension to which the bolt locked. This allowed a lightweight aluminum receiver to be used while still maintaining a steel-on-steel lockup. The bolt was operated by high-pressure combustion gases taken from a hole in the middle of the barrel directly through a tube above the barrel to a cylinder created in the bolt carrier with the bolt carrier itself acting as a piston. Traditional rifles located this cylinder and piston close to the gas vent. The stock and grips were made of a glass-reinforced plastic shell over a rigid foam plastic core. The muzzle brake was fabricated from titanium. The layout of the weapon itself was also somewhat unique. Previous designs generally placed the sights directly on the barrel, using a bend in the stock to align the sights at eye level while transferring the recoil down to the shoulder. This meant that the weapon tended to rise when fired making it very difficult to control during fully-automatic fire. The ArmaLite team used a solution previously used on weapons such as the German FG 42 and Johnson light machine gun; the barrel was in line with the stock, well below eye level, with the sights to eye level. The rear sight was built into a carrying handle over the receiver. The AR-10 was a very advanced design for its time. Despite being over 2 lb (0.9 kg) lighter than the competition, it offered significantly greater accuracy and recoil control. Two prototype rifles were delivered to the U.S. Army's Springfield Armory for testing late in 1956. At this time, the U.S. armed forces were already two years into a service rifle evaluation program, and the AR-10 was a newcomer with respect to older, more fully-developed designs. Unfortunately, ArmaLite's president, George Sullivan, insisted that both prototypes be fitted with barrels made of aluminum extruded over a thin stainless steel liner. Shortly after the aluminum-steel composite barrel burst on one of the prototypes in 1957, the AR-10 was rejected. However, later that same year, General Willard G. Wyman, commander of the U.S. Continental Army Command (CONARC) put together a team to develop a .223 caliber (5.56 mm) weapon. Wyman had seen the AR-10 in an earlier demonstration and, impressed by its performance, personally suggested that ArmaLite enter an AR-10 modified to use a 5.56 mm cartridge designed by Winchester. ArmaLite commissioned Stoner's chief assistant, Robert Fremont, and Jim Sullivan, another employee, with the task of scaling down the basic AR-10 design to fire the small-caliber .223 Winchester cartridge. When improper assembly of the prototypes being tested resulted in CONRAC rejecting the design, Fairchild, which had already spent $1.45 million in development costs with no potential return on the investment, decided to bail out of the small-arms business. Fairchild thereafter sold production rights for the AR-15 to Colt Firearms in December 1959, for a mere $75,000 in cash and a 4.5% royalty on subsequent sales. In 1960, ArmaLite was reorganized, and Stoner left the company. Given such an inauspicious beginning, it would have been difficult to predict that within five years, the AR-15 would be adopted by United States military forces as the M16 rifle, and that it and variants thereof would be in continuous production well into the twenty-first century.

The M4 carbine is a family of firearms tracing its lineage back to earlier carbine versions of the M16, all based on the original AR-15 made by ArmaLite. It is a shorter and lighter version of the M16A2 assault rifle, achieving 80% parts commonality with the M16A2. The M4 has selective fire options including semi-automatic and three-round burst (like the M16A2), while the M4A1 has a "full auto" option in place of the three-round burst.

One problem associated with the firing of any assault rifle is that of maintaining adequate stabilization of the buttstock against the shoulder. As the weapon is fired—particularly in automatic mode—, the buttstock tends to slide off the shoulder, thereby diminishing firing accuracy, and requiring the shooter to repeatedly recenter the buttstock on his shoulder.

Another problem associated with the firing of an assault rifle is that of maintaining uniformity of deployment as the rifle is brought to the shoulder in firing position. Typically, the more rapidly the rifle is brought to firing position against the shoulder, the greater the variation in positioning of the buttstock against the shoulder. Greater variability and less uniformity in positioning of the rifle in firing position invariably results in reduced firing accuracy.

What is needed is an apparatus that not only stabilizes the buttstock of an assault rifle as it is repeatedly fired, but also reduces variability in positioning of the buttstock against the shooter's shoulder. The apparatus must not delay the time required to shoulder the weapon and commence firing. The apparatus must also provide for both lateral and vertical arcuate movement of the barrel so that the assault weapon can be omnidirectionally aimed in front of the shooter.

SUMMARY OF THE INVENTION

The present invention fulfills the heretofore expressed need for an apparatus for stabilizing the buttstock of an assault rifle as it is repeatedly fired. The apparatus includes two items. The first is a locator ball assembly, which is a spherical ball from which a cylindrical stud radially projects. The cylindrical stud has a threaded end portion that screws into the sling mount on the lower rear face of the buttstock of M16 series rifles (M16, M16A1, M16A2, M16A3, M16A4) and M4 carbines. The ball and stud can be integrally machined from a metal such as titanium or stainless steel, or the ball can be made of thermoplastic material injection molded about a titanium, steel, or stainless steel cylindrical stud. The second item is a socket assembly comprising an oblong horizontally-disposed socket connected to a lower approach ramp. A wall surrounds upper and side portions of the socket and the side edges of the approach ramp. The socket assembly is preferably injection molded from a tough structural plastic, such as nylon, polycarbonate (PC), acrylonitrile/butadiene/styrene (ABS), polypropylene (PP), polyvinylchloride (PVC), or polyester (PE). Although the socket assembly may be of unitary construction, in the interest of reducing mold costs, it may be molded in multiple pieces, which are subsequently assembled as a unit. Although the socket assembly may also be machined from a block of lightweight metal, such as aluminum or magnesium, polymer materials are deemed to be safer, as they will not fragment into dangerous shrapnel if impacted by a bullet. The socket assembly, which is bilaterally symmetrical, is provided with slots which enable it to be strapped to a soldiers flak jacket or body armor near either shoulder (depending on whether the soldier is right or left handed). When the soldier brings his weapon to firing position, the ball projecting from the buttstock hits the access ramp and slides into the oblong socket of the socket assembly. Although the side of the oblong socket positioned farthest from the soldier's neck is generally used for stabilization, the other side of the socket may come into play if the rifle is pivoted to the outside of the rifleman's body. However, the socket assembly may be strapped to either shoulder in order to accommodate both right-handed and left-handed individuals. If the socket assembly is manufactured from a polymeric compound, the opening of the oblong socket may be slightly smaller than the diameter of the ball, thereby providing a slight interference fit between the ball and the socket. The ball and socket arrangement allows the shooter to radially pivot the firearm at the ball and socket joint, thereby providing great aiming flexibility coupled with firing stabilization.

DETAILED DISCLOSURE OF THE INVENTION

The invention will now be described in detail with reference to the attached drawing figures. It should be understood that the figures are not necessarily drawn to scale and that they are intended to be merely illustrative of the invention.

Figures 1, 2, 3:
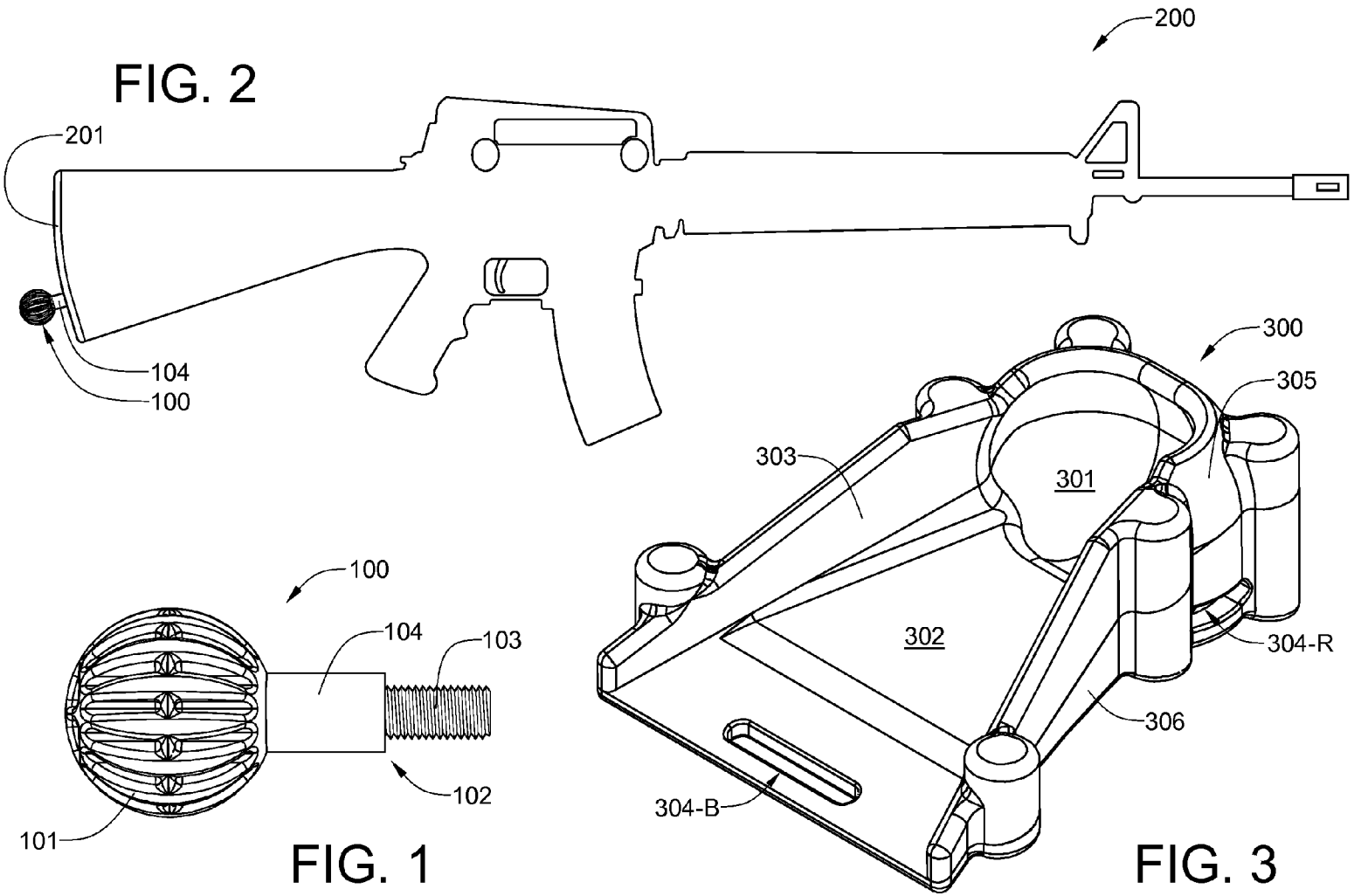
FIG. 1 is a side elevational view of a locator ball having a radially-projecting cylindrical stud.
FIG. 2 is a side elevational outline view of an M16A4 assault rifle having a locator ball threadably secured to the sling mount of the buttstock end plate.
FIG. 3 is an isometric view of the socket assembly.

Referring now to FIG. 1, a locator ball assembly 100 includes a ball 101 and a stud 102 which radially projects from the ball 101. The stud 102 has an outer threaded screw portion 103 and an unthreaded inner shank portion 104 having a diameter that is larger than that of the threaded screw portion 103. The outer threaded screw portion 103 is sized and appropriately threaded so as to engage the female threads of the sling mount on the lower rear face of the buttstock end plate of M16 series rifles (M16, M16A1, M16A2, M16A3, M16A4) and M4 carbines. The locator ball assembly 100 can be integrally machined from a metal such as titanium or stainless steel, or the ball 101 can be made of a tough thermoplastic material injection molded about a titanium, steel, or stainless steel cylindrical stud 102.

Referring now to FIG. 2, a locator ball assembly 100 has been threadably secured to the sling mount of the buttstock end plate 201 of an M16A4 assault rifle 200. It will be noted that the ball 101 is spaced away from the buttstock end plate 201 by the inner shank portion 104 of the stud 102, as though mounted on a stalk.

Referring now to FIG. 3, a fully-assembled socket assembly 300 is shown. The socket assembly 300 is designed to be strapped to the right or left shoulder of a flak jacket or other body armor in order to accommodate both right and left-handed shooters. The socket assembly 300 is bilaterally symmetrical and includes an oblong horizontally-disposed socket 301 that is connected to an approach ramp 302. A wall 303 surrounds the upper and side portions of the socket 301 and the side edges of the approach ramp 302. It will be noted that a bottom strap slot 304-B and a right-side strap slot 304-R are visible in this view. The socket assembly 300 is preferably injection molded from a tough structural plastic, such as nylon, polycarbonate (PC), polypropylene (PP), acrylonitrile/butadiene/styrene (ABS), polyvinylchloride (PVC), or polyester (PE). Although the socket assembly 300 may be of unitary construction, in the interest of reducing mold costs, it may be molded as two pieces, which include a perimetric wall component 305 and a ramp and socket component 306, which are subsequently assembled as a unit using chemical bonding, threaded fasteners, rivets, or a combination of those securing methods. Although the socket assembly 300 may also be machined from a block of lightweight metal, such as aluminum or magnesium, polymer materials are deemed to be safer, as they will not fragment into dangerous shrapnel if impacted by a bullet. The socket assembly 300, which is bilaterally symmetrical, is provided with slots which enable it to be strapped to a soldiers flak jacket or body armor near either shoulder (depending on whether the soldier is right or left handed). The socket assembly 300 is positioned on the shoulder of the flak jacket such that the approach ramp 302 is below the horizontally-disposed oblong socket 301. When the soldier brings his weapon to firing position, the spherical ball 101 projecting from the buttstock end plate 201 hits the approach ramp 302 and slides into the oblong socket 301 of the socket assembly 300. Although the side of the oblong socket 301 positioned farthest from the soldier's neck is generally used for stabilization, the other side of the socket may come into play if the rifle is pivoted to the outside of the rifleman's body. If the socket assembly 300 is manufactured from a polymeric compound, the opening of the oblong socket 301 may be slightly smaller than the diameter of the ball 101, thereby providing a slight interference fit between the ball 101 and the socket 301. The ball and socket arrangement allows the shooter to radially pivot the firearm at the ball and socket joint, thereby providing great aiming flexibility coupled with firing stabilization.

Figure 4:
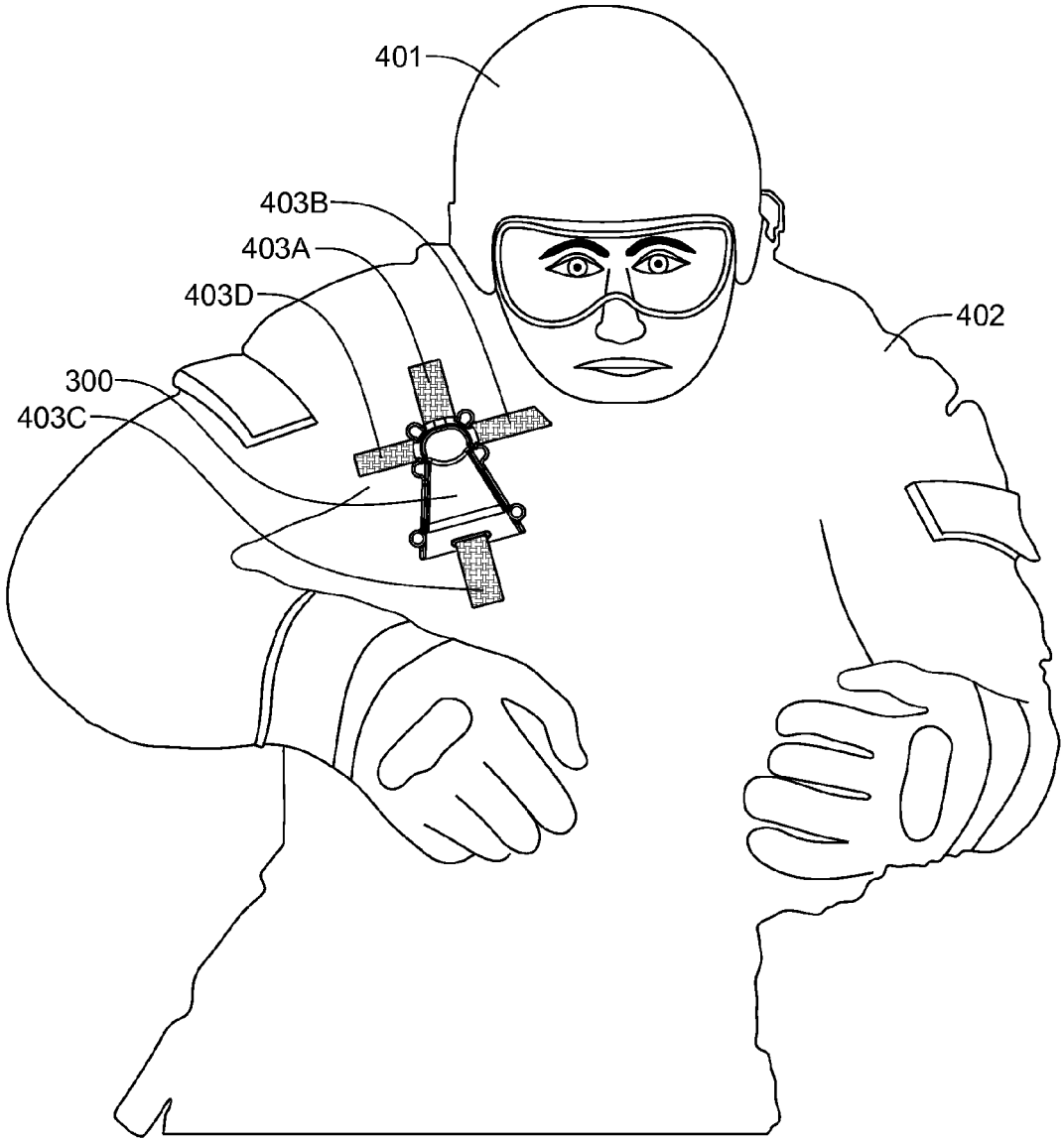
FIG. 4 is a front view of an infantryman wearing a flak jacket with a socket assembly strapped thereto.

Referring now to FIG. 4, an infantryman 401 is shown wearing a flak jacket 402 with a socket assembly 300 strapped thereto. The securing straps 403A, 403B, 403C and 403D, which attach the socket assembly 300 to the flak jacket 402, can be sewn to the flak jacket, secured to the flak jacket with hook and loop fasteners, or adhesively secured to the flak jacket. The hook and loop fasteners are considered the preferred attachment method, as the of the position of the socket assembly 300 on the flak jacket 402 is much more easily adjusted. Flak jackets are typically equipped with a grid of integral anchoring straps which are permanently sewn to the front of the flak jacket. The securing straps 403A-403D straps can be equipped with both hook and loop fastener components, which enable the securing straps to be wrapped around individual anchoring straps. In order to secure the socket assembly on the side adjacent the rifleman's neck, a strap may be wrapped beneath the collar and may attach beneath the collar by means of hook and loop fasteners.

Figure 5:
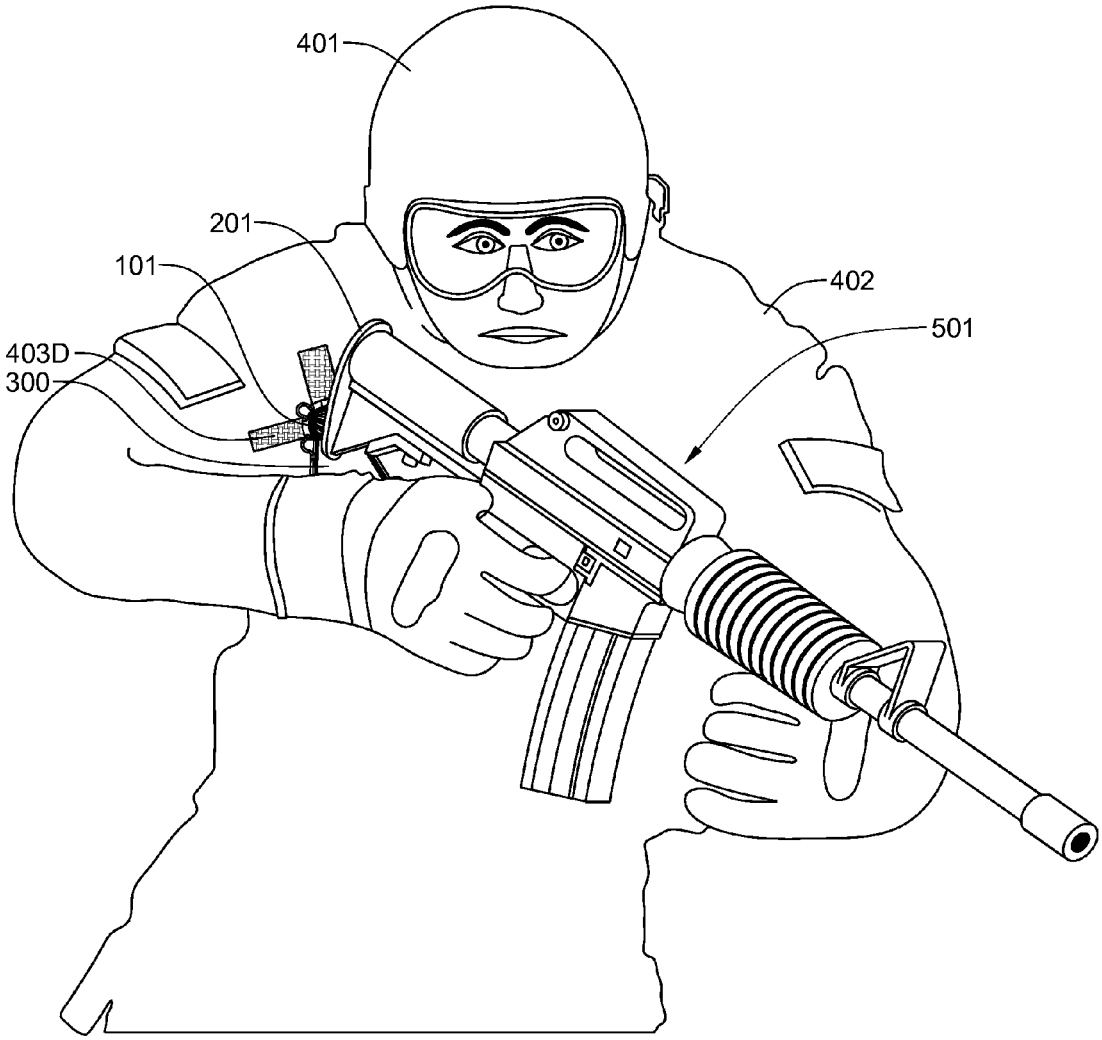
FIG. 5 is a front view of the infantryman of FIG. 4 holding an M4A1 carbine, the buttstock of which is equipped with a locator ball that has engaged the socket of the socket assembly.

Referring now to FIG. 5, the infantryman 401 of FIG. 4 is holding an M4A1 carbine 501, the buttstock of which is equipped with a locator ball assembly 100, the ball 101 of which has engaged the socket 301 of the socket assembly 300.

Figure 6:
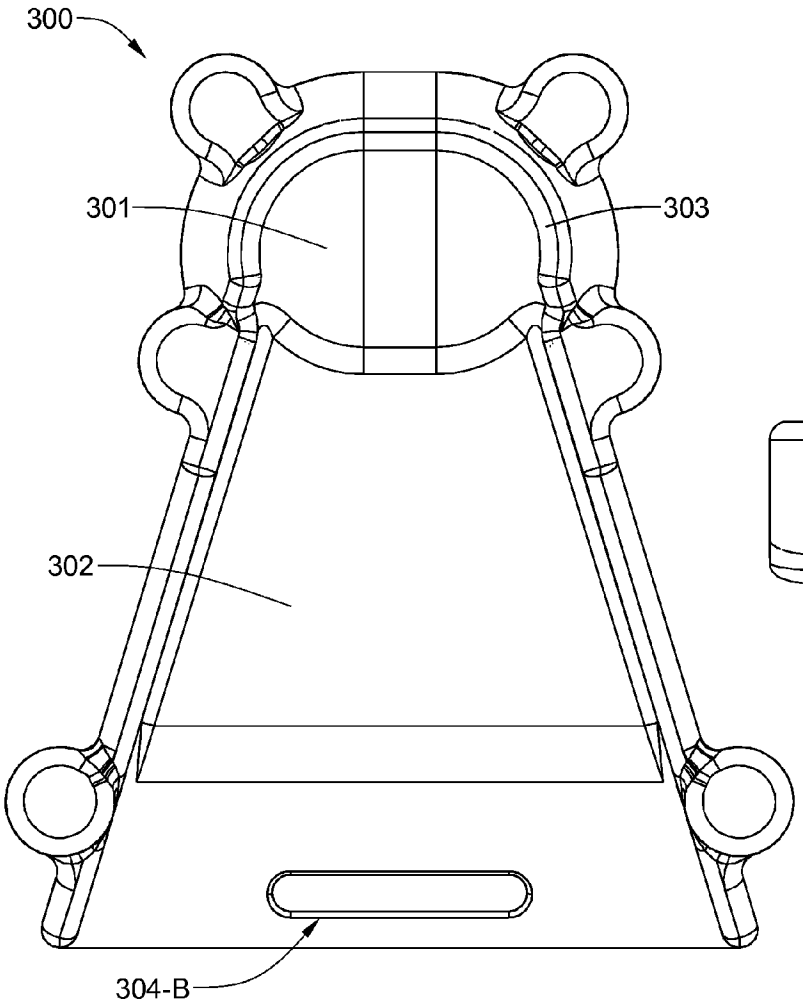
FIG. 6 is a front elevational view of the socket assembly.

Referring now to FIG. 6, this front view of the socket assembly 300 shows the oblong socket 301, the approach ramp 302, the wall 303 surrounding the socket 301 and approach ramp 302, and the bottom strap slot 304-B.

Figure 7:
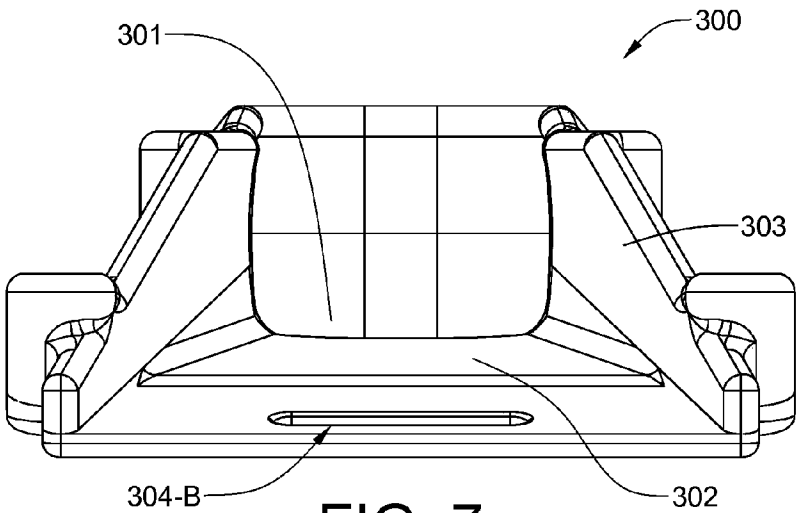
FIG. 7 is a bottom plan view of the socket assembly.

Referring now to FIG. 7, this bottom view of the socket assembly 300 shows the approach ramp 302, the wall 303 surrounding the upper and side portions of the socket 301 and the side edges of the approach ramp 302, and the bottom strap slot 304-B.

Figure 8:
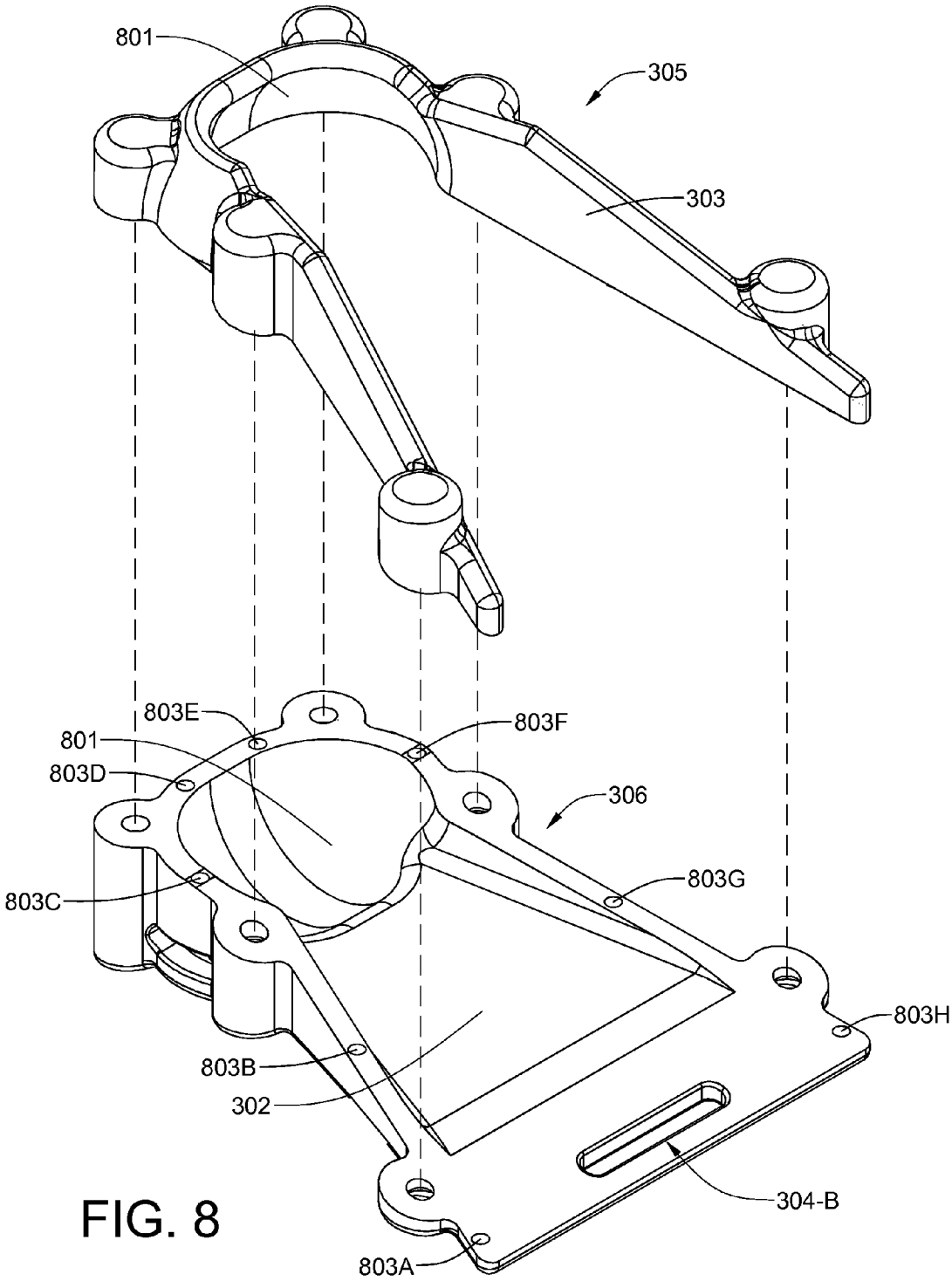
FIG. 8 is an exploded isometric view of the socket assembly.

Referring now to FIG. 8, this exploded view shows the perimetric wall component 305 and the ramp and socket component 306 of the socket assembly 300. It will be noted that a rear portion 801 of the oblong socket 301 is located on the ramp and socket component 306, while an upper portion 802 is located on the perimetric wall component 305. As will be shown in a subsequent drawing FIGS. 9 and 11, the two components 305 and 306 are held together with self-tapping screws. Nevertheless, the two components 305 and 306 may be also be assembled as a unit using chemical bonding, other types of threaded fasteners, rivets, or a combination of those securing methods. It will be noted that the ramp and socket component 306 is equipped with eight alignment recesses 803A, 803B, 803C, 803D, 803E, 803F, 803G and 803H, which engage eight alignment nipples visible in FIG. 11, thereby providing alignment of the perimetric wall component 305 with the ramp and socket component 306.

Figure 9:
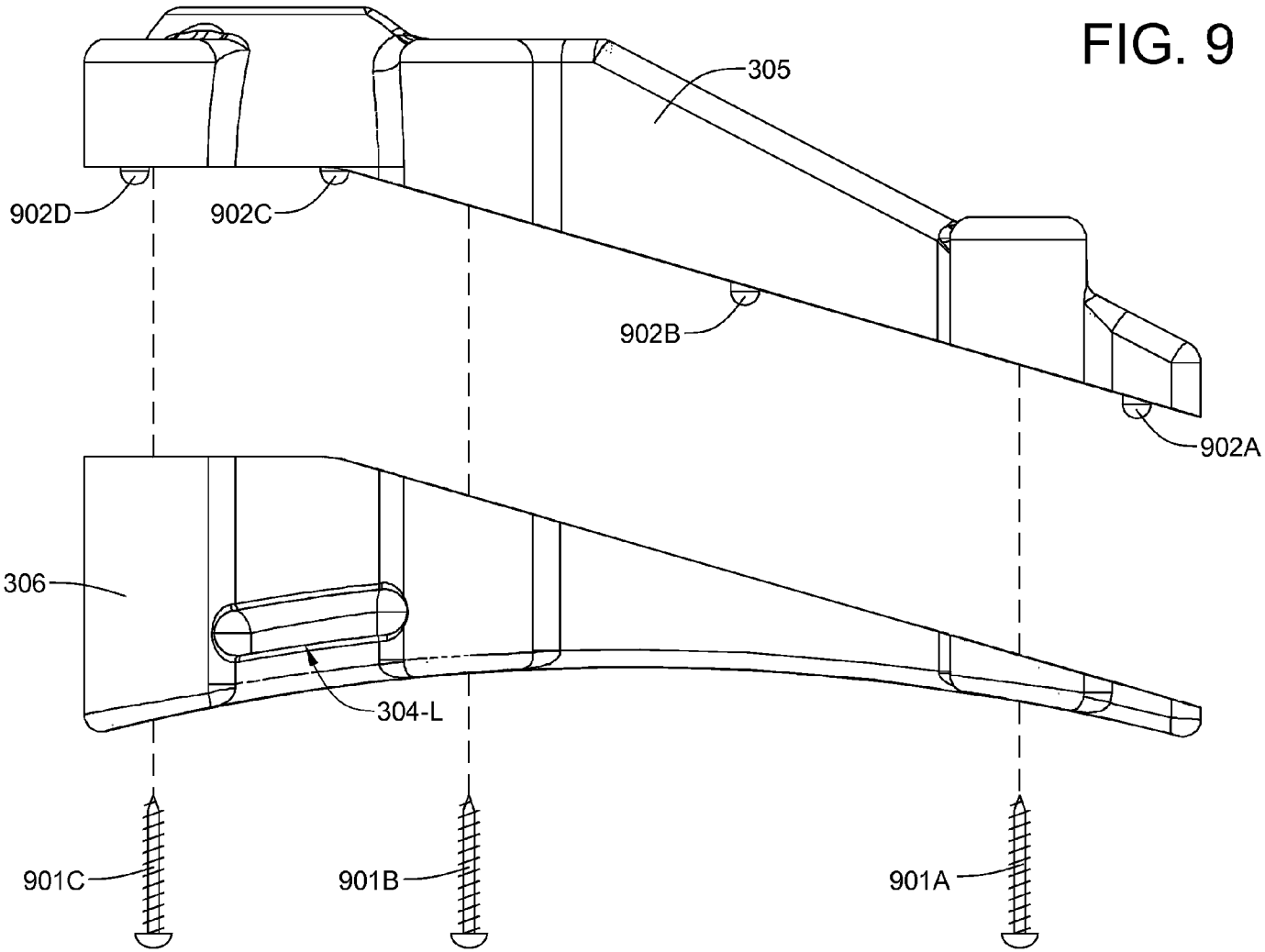
FIG. 9 is an exploded left-side elevational view of the socket assembly.

Referring now to FIG. 9, this left-side exploded view of the socket assembly 300 shows three of the self-tapping screws 901A, 901B and 901C that are used to secure the ramp and socket component 306 to the perimetric wall component 305. Also visible in this view are four alignment nipples 1101A, 1101B, 1101C, 1101D of a total of eight that are visible in FIG. 11.

Figure 10:
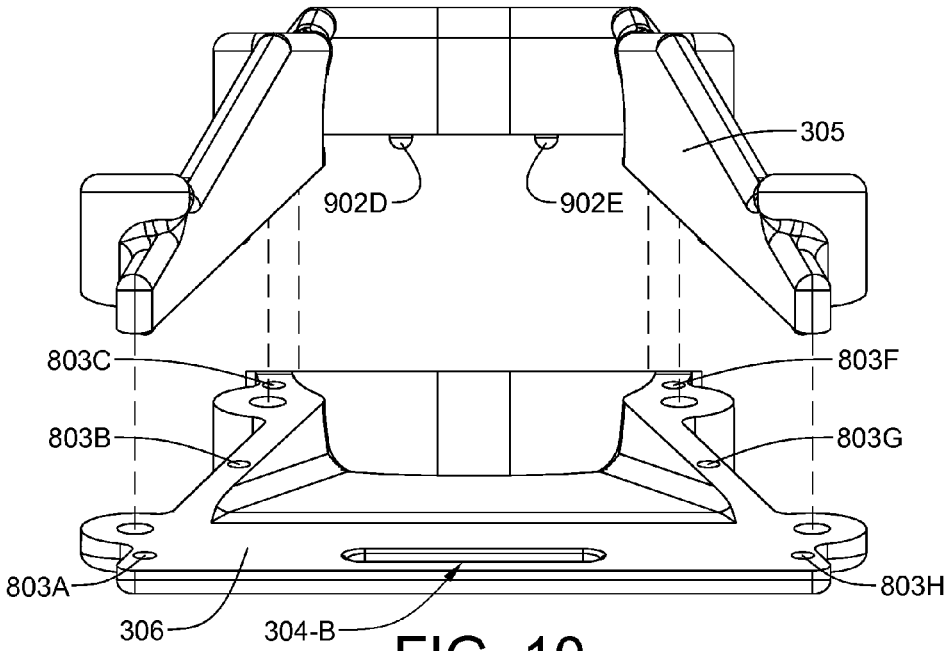
FIG. 10 is an exploded bottom plan view of the socket assembly.

Referring now to FIG. 10, this bottom exploded view shows the shape of the perimetric wall component 305 and the ramp and socket component 306 from a different vantage point.

Figure 11:
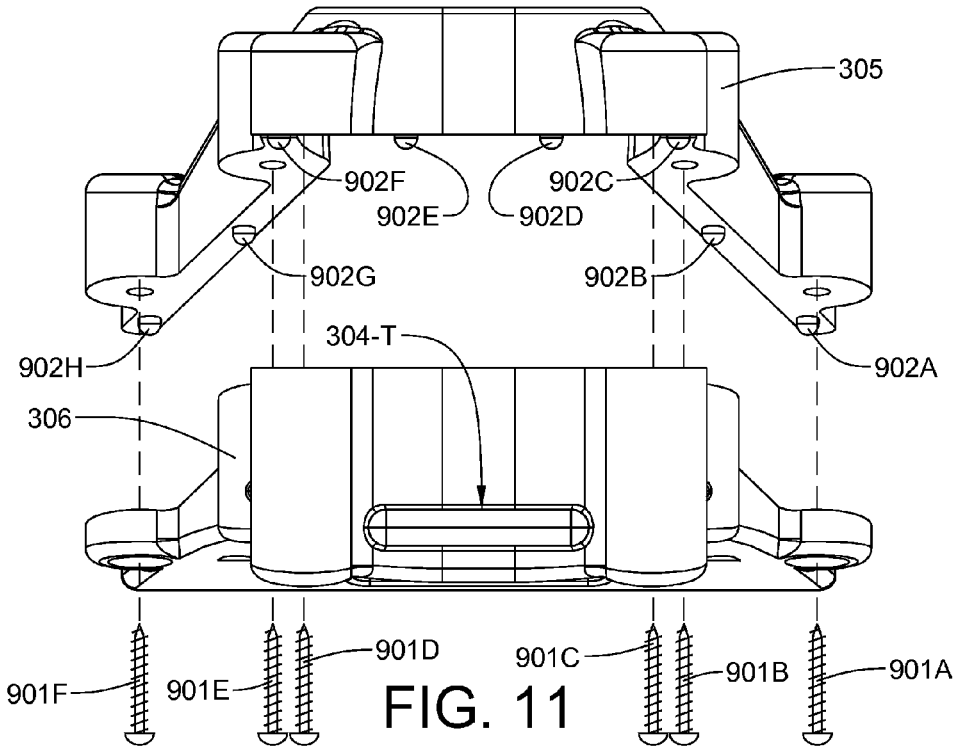
FIG. 11 is an exploded top plan view of the socket assembly.

Referring now to FIG. 11, this top exploded view shows the shape of the perimetric wall component 305 and the ramp and socket component 306 from an additional vantage point. It will be noted that the perimetric wall component 305 is equipped with alignment nipples 1101A, 1101B, 1101C, 1101D, 1101E, 1101F, 1101G and 1101H, which align the perimetric wall component 305 to the ramp and socket component 306. All six of the self-tapping screws 901A, 901B, 901C, 901D, 901E and 901F that are used to secure the ramp and socket component 306 to the perimetric wall component 305 are shown. It will also be noted that a top strap slot 304-T is visible in this view.

Figure 12:
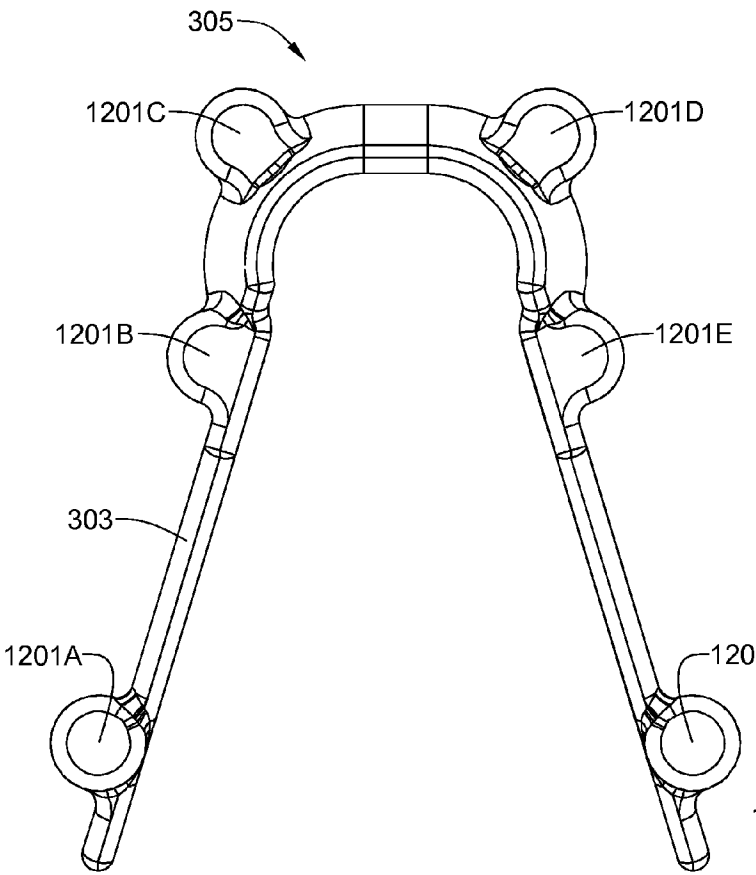
FIG. 12 is a front elevational view of the perimetric wall component of the socket assembly.

Referring now to FIG. 12, this front view of perimetric wall component 305 shows six attachment posts 1201A, 1201B, 1201C, 1201D, 1201E, and 1201F, which are spaced along the perimetric wall 303 and capture the threaded ends of the self-tapping screws 901A, 901B, 901C, 901D, 901E and 901F used to secure the ramp and socket component 306 to the perimetric wall component 305.

Figure 13:
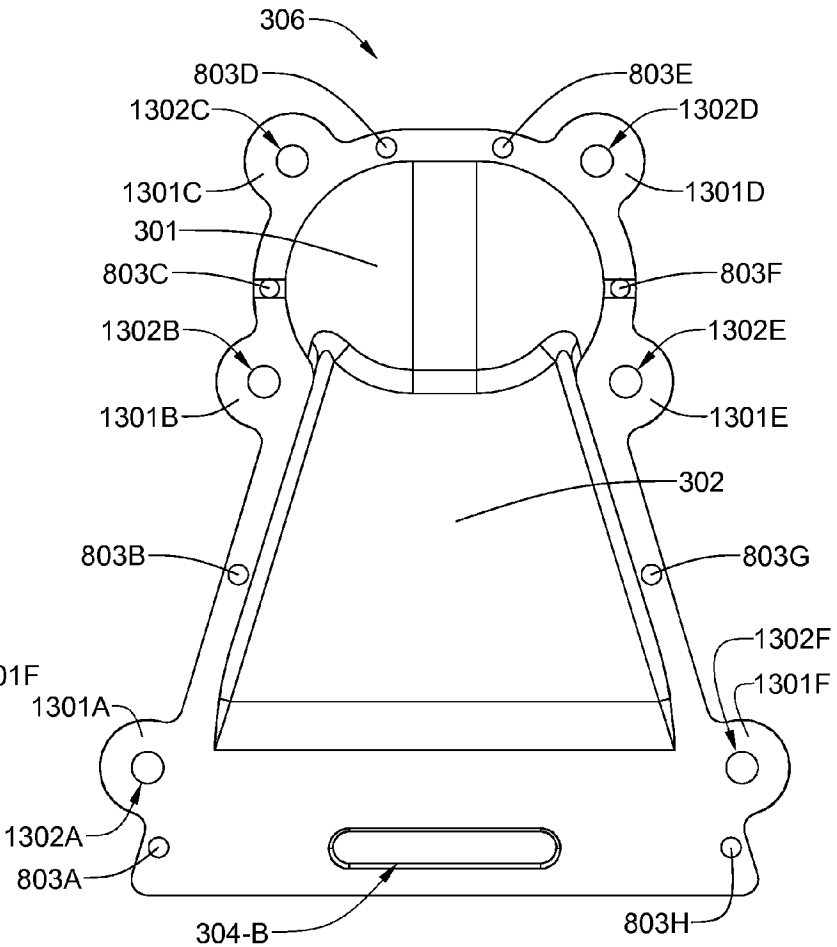
FIG. 13 is a front elevational view of the ramp and socket component of the socket assembly.

Referring now to FIG. 13, this front view of the ramp and socket component 306 clearly shows the six ears 1301A, 1301B, 1301C, 1301D, 1301E and 1301F respectively having holes 1302A, 1302B, 1302C, 1302D, 1302E and 1302F through which the self-tapping screws 901A, 901B, 901C, 901D, 901E and 901F enter on their way to the six attachment posts 1201A, 1201B, 1201C, 1201D, 1201E, and 1201F, respectively.

Figure 14:
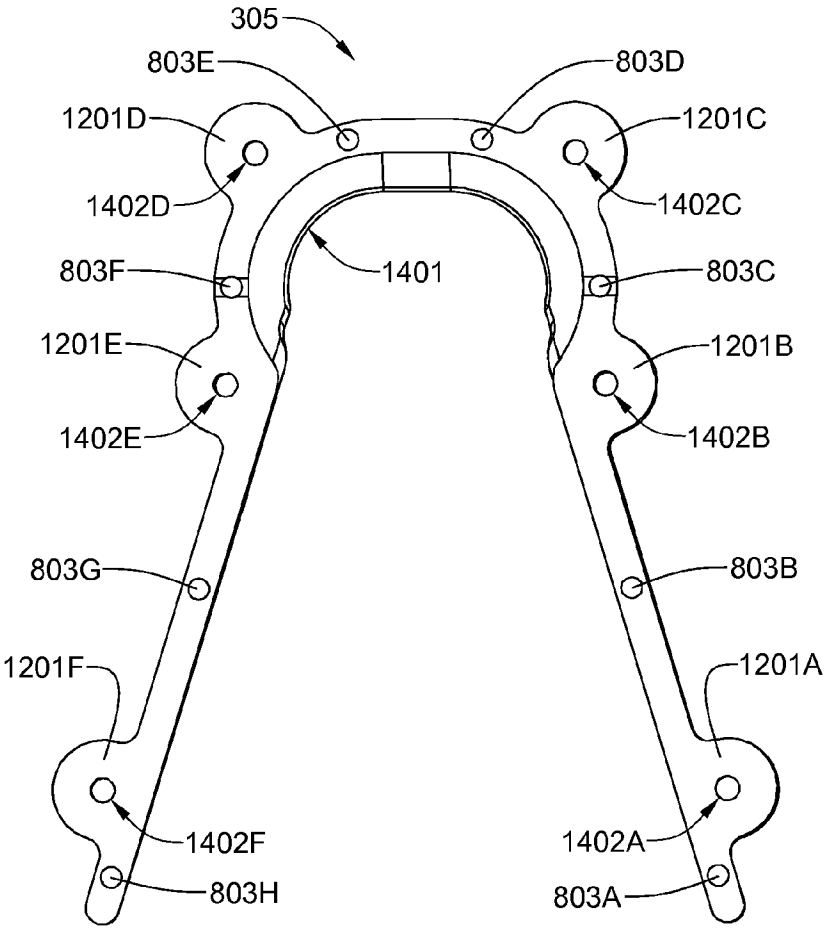
FIG. 14 is a rear elevational view of the perimetric wall component of the socket assembly.
Figure 16:
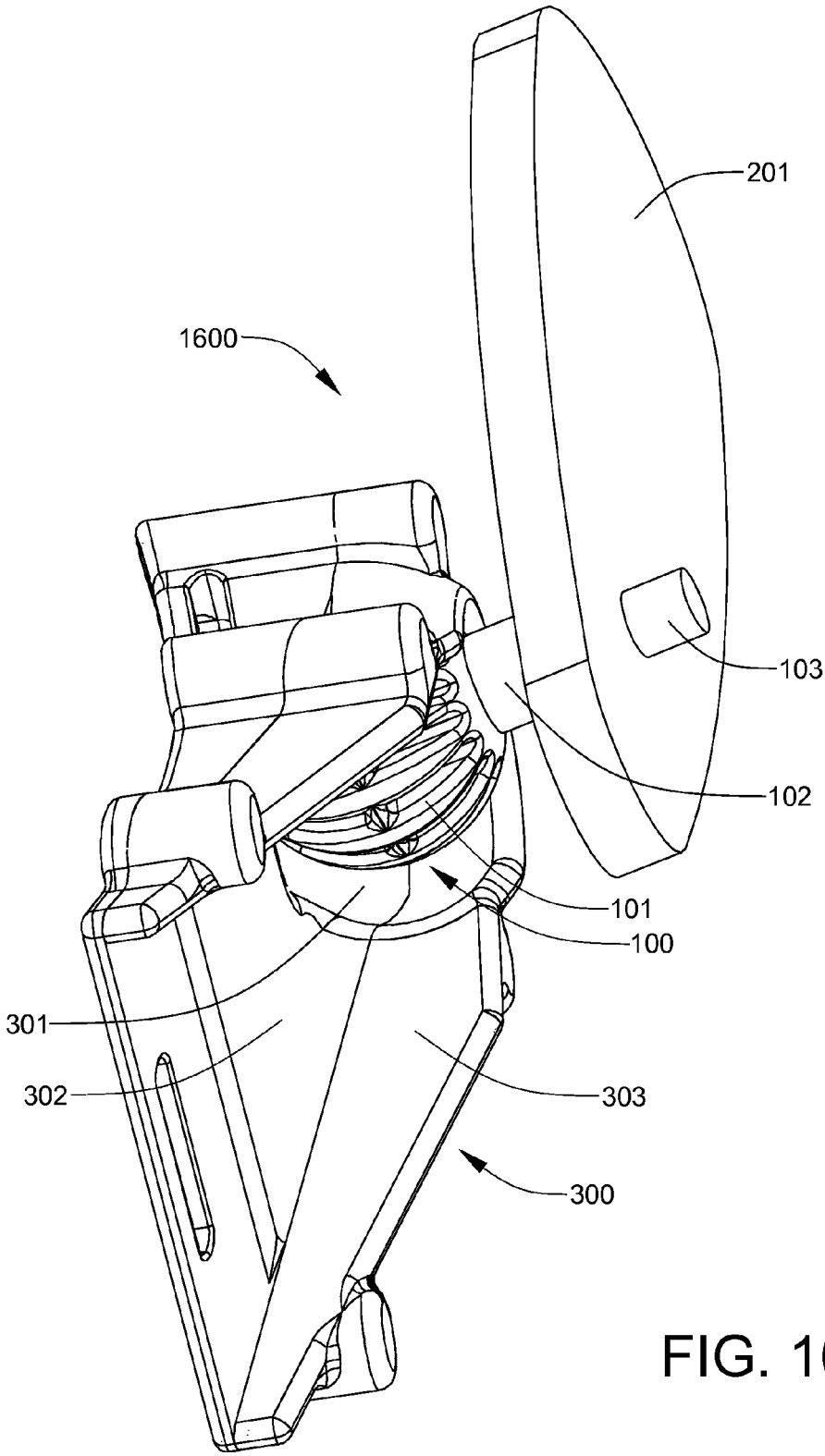
FIG. 16 is a lower-left-front isometric view of the socket assembly, the socket of which has engaged a locator ball, the locator ball having been secured to a buttstock end plate via the threaded end of its cylindrical stud.
Figure 17:
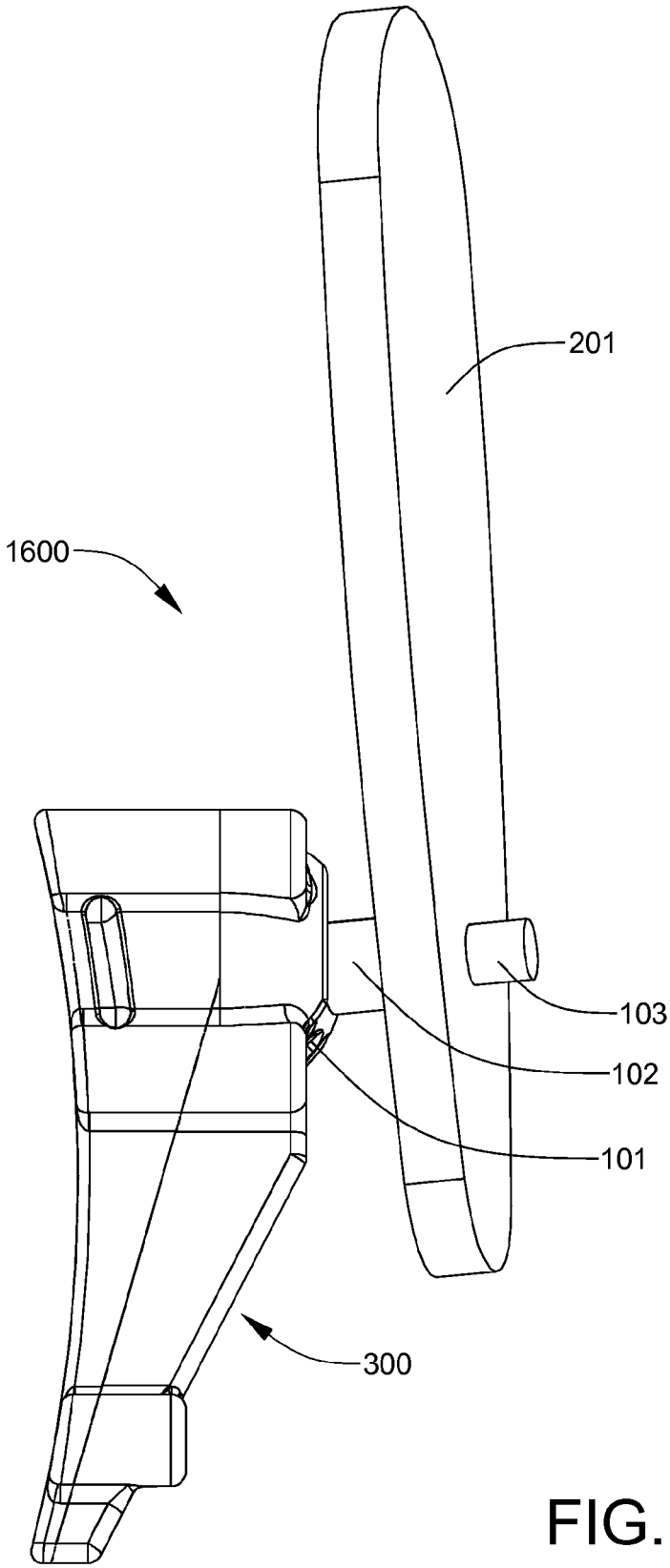
FIG. 17 is a left side elevational view of the socket assembly, the socket of which has engaged a locator ball, the locator ball having been secured to a buttstock end plate via the threaded screw portion of its cylindrical stud.
Figure 18:
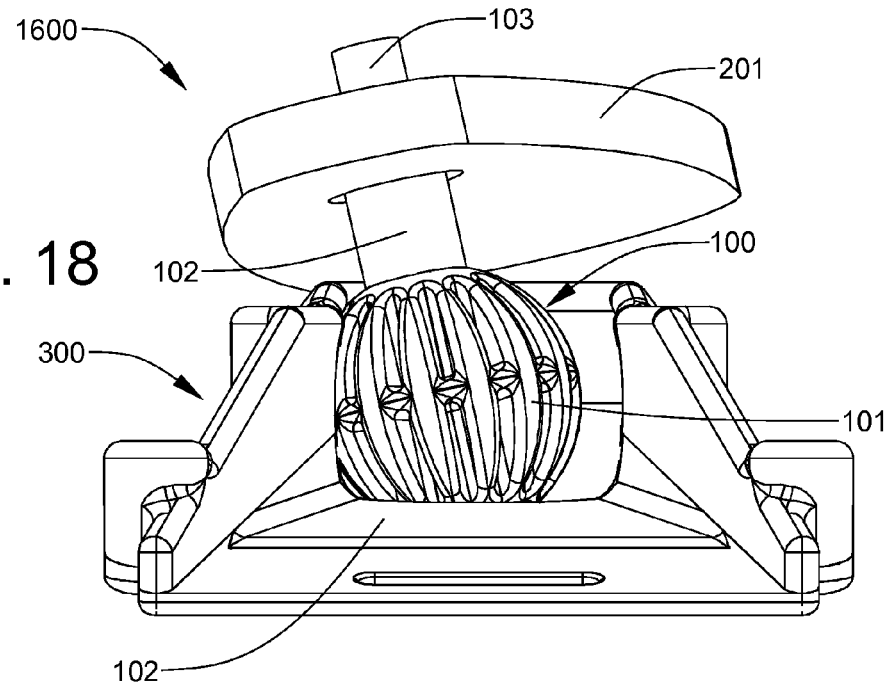
FIG. 18 is bottom plan view of the socket assembly, the socket of which has engaged a locator ball, the locator ball having been secured to a buttstock end plate via the threaded screw portion of its cylindrical stud.
Figure 19:
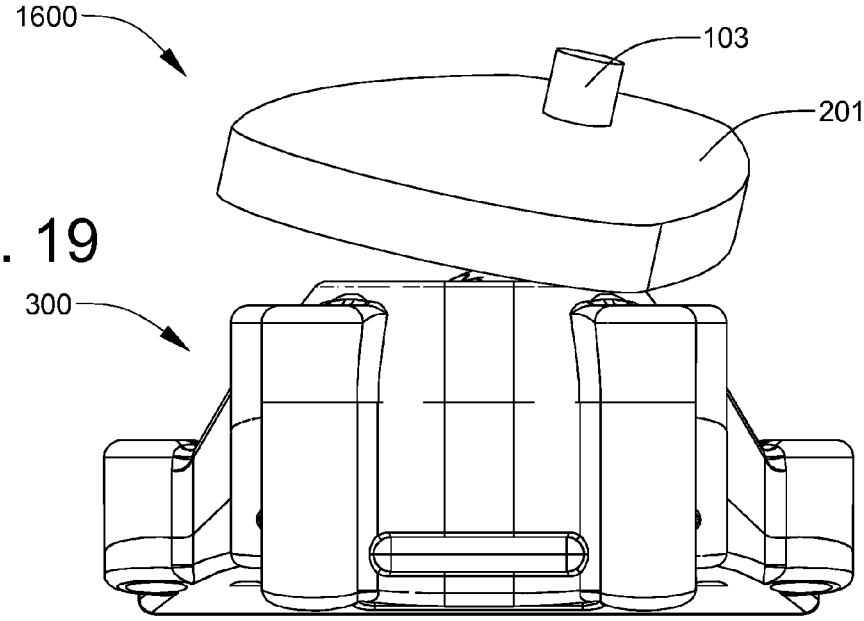
FIG. 19 is a top plan view of the socket assembly, the socket of which has engaged a locator ball, the locator ball having been secured to a buttstock end plate via the threaded screw portion of its cylindrical stud.
Figure 20:
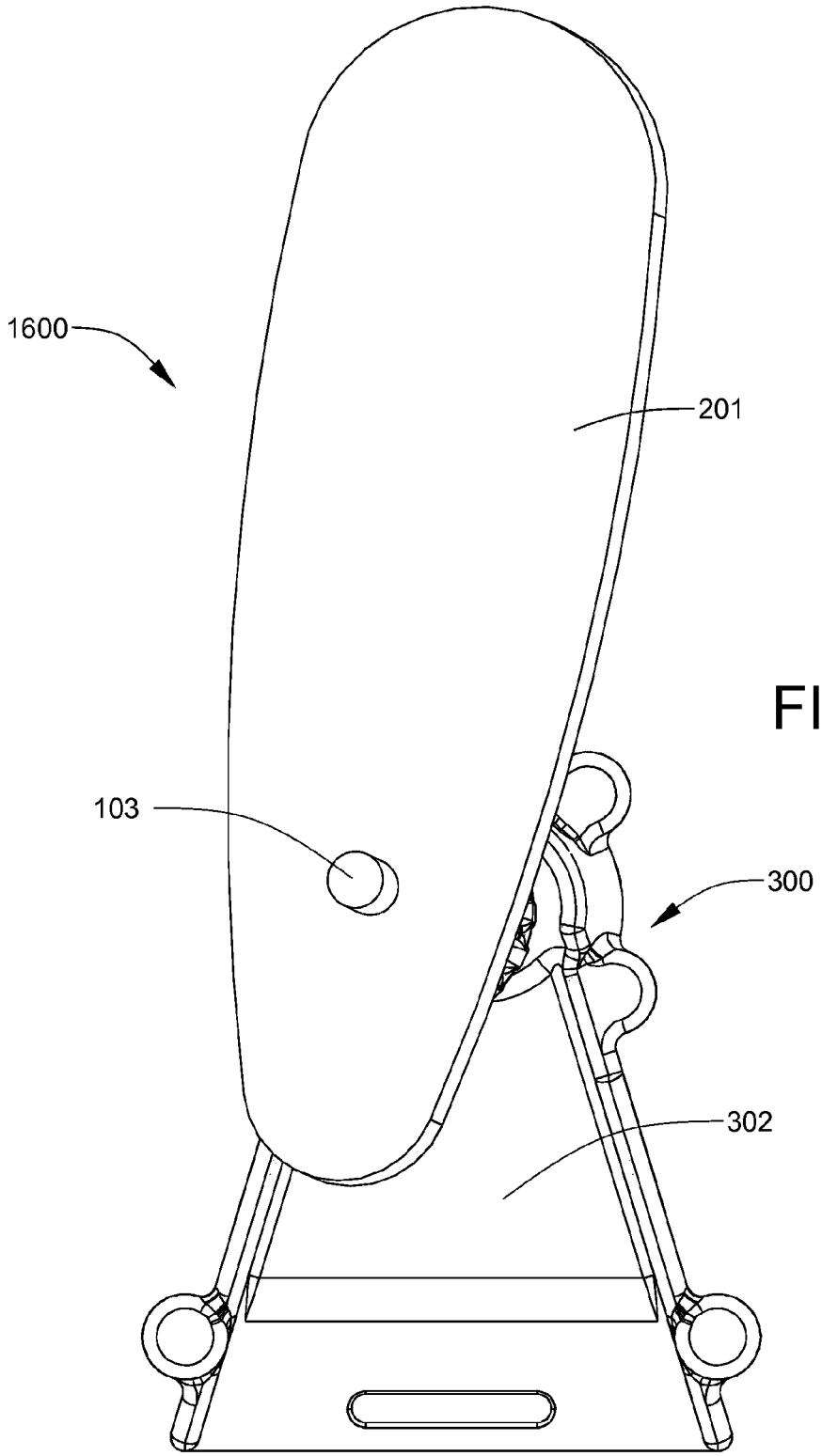
FIG. 20 is a front elevational view of the socket assembly, the socket of which has engaged a locator ball, the locator ball having been secured to a buttstock end plate via the threaded screw portion of its cylindrical stud.
Figure 21:
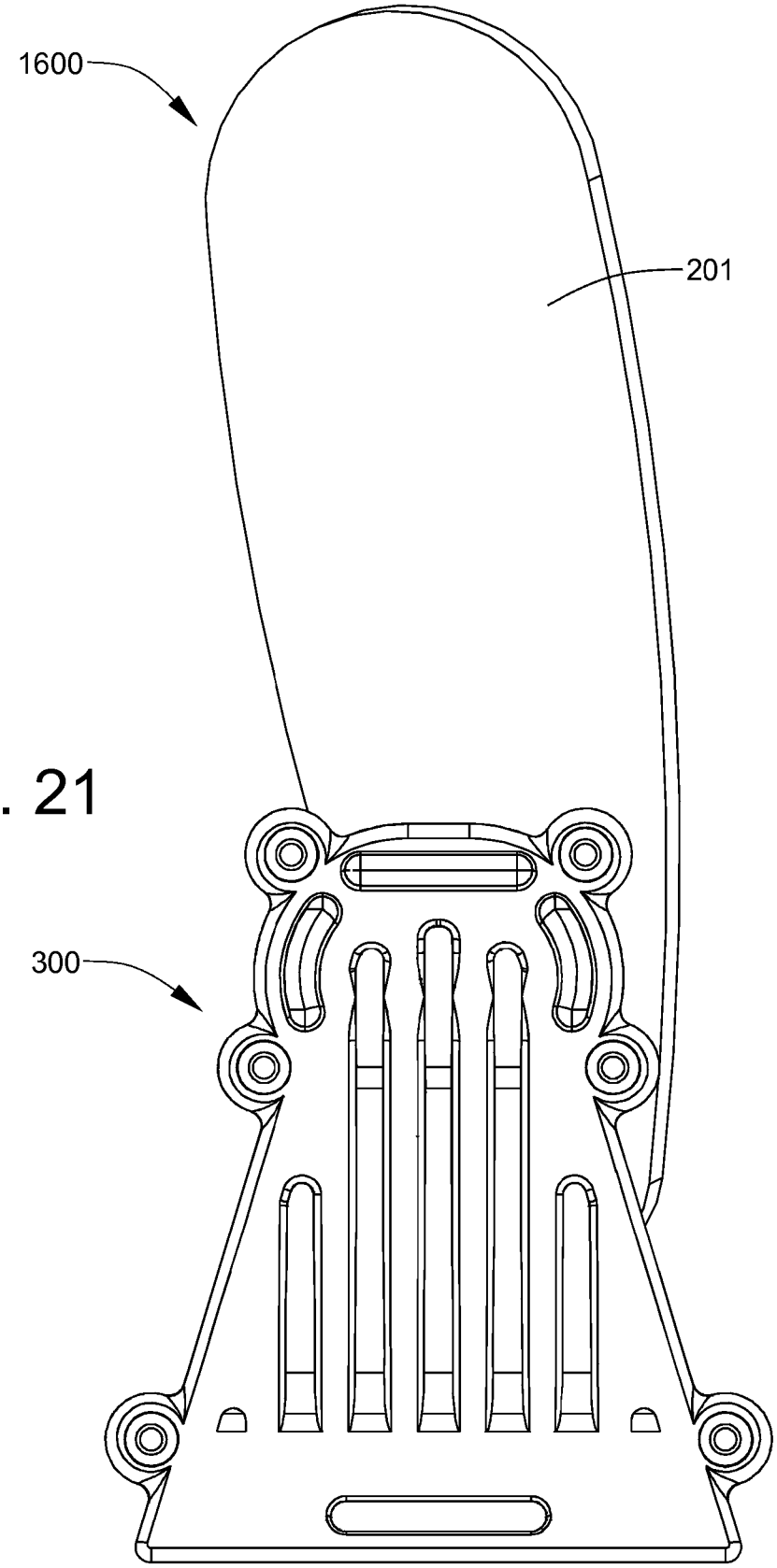
FIG. 21 is a rear elevational view of the socket assembly, the socket of which has engaged a locator ball, the locator ball having been secured to a buttstock end plate via the threaded screw portion of its cylindrical stud.

Referring now to FIG. 14, this rear view of the perimetric wall component of the socket assembly shows how the uppermost portion 1401 of the wall 303 curves inwardly over the oblong socket 301 of the ramp and socket component 306, thereby becoming an upper part of that socket. Also clearly visible in this view are the eight alignment nipples 1101A, 1101B, 1101C, 1101D, 1101E, 1101F, 1101G and 1101H, which align the perimetric wall component 305 to the ramp and socket component 306. Further visible in this view are six anchoring holes 1402A, 1402B, 1402C, 1402D, 1402E and 1402F in attachment posts 1201A, 1201B, 1201C, 1201D, 1201E, and 1201F, respectively, which will anchor the self-tapping screws 901A, 901B, 901C, 901D, 901E and 901F.

Figure 15:
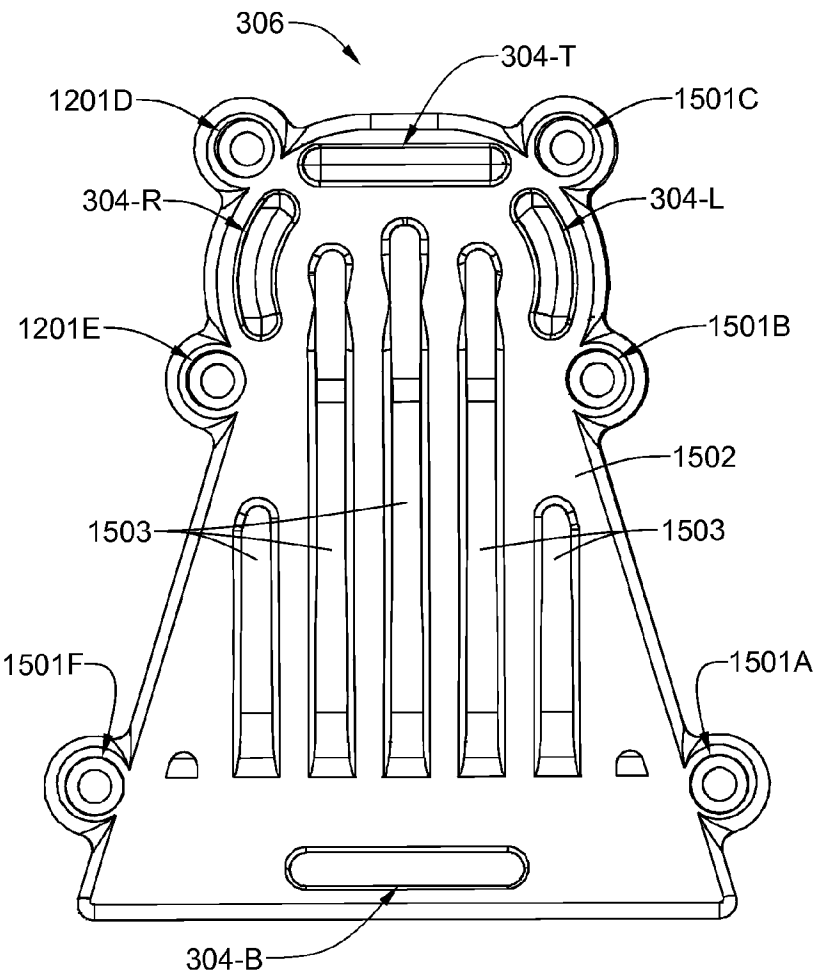
FIG. 15 is a rear elevational view of the ramp and socket component of the socket assembly.

Referring now to FIG. 15, this rear view of the ramp and socket component 306 clearly shows the bottom strap slot 304-B, the top strap slot 304-T, the right strap slot 304-R and the left strap slot 304-L. These slots are used to anchor straps which are used to secure the socket assembly 300 to the flak jacket or body armor of the infantryman. Also visible in this view are the recesses 1501A, 1501B, 1501C, 1501D, 1501E, and 1501F in which the heads of the self-tapping screws 901A, 901B, 901C, 901D, 901E and 901F are positioned when the perimetric wall component 305 and the ramp and socket component 306 are secured together. It will be noted that the rear face 1502 of the ramp and socket component 306 has a plurality of grooves 1503 for strength and lightness.

Referring now to FIGS. 16 through 21, a socket assembly 300, a locator ball assembly 100, and a buttstock end plate 201 from an assault rifle or carbine are shown as a single assemblage 1600 from different vantage points. It will be noted that the spherical ball 101 of the locator ball assembly 100 has engaged the oblong, horizontally-disposed socket 301 of the socket assembly 300. It will also be noted that, in the interest of graphic simplification, only the buttstock end plate 201 of the rifle or carbine is shown, and the machined threads on the threaded screw portion 103 of cylindrical stud 102, which projects through the buttstock end plate 201, are not shown. It should be understood that although the invention was designed for use with the M16 series rifles and the M4 series carbines in mind, the invention may be used with any shoulder-fired rifle in both military and hunting and target-practice applications. For non-military applications, the socket assembly 300 may be secured to the shooter's outer clothing by means similar to those already disclosed.

Although only a single embodiment of the present invention have been disclosed herein, it will be obvious to those having ordinary skill in the art that changes and modifications may be made thereto without departing from the scope and spirit of the invention as hereinafter claimed.

What is claimed is:

1. In combination with a rifle having a buttstock, an aiming and stabilization system comprising:

a socket assembly having an oblong horizontally-disposed socket, an approach ramp in communication with and positioned below the oblong socket, and a wall surrounding upper and side portions of the oblong socket and side edges of the approach ramp, said socket assembly being attached to a front shoulder portion of an article of clothing wearable by a shooter, the approach ramp having an upper end immediately below the oblong socket and a lower end below the upper end, the lower end including a means for fastening the lower end of the approach ramp to the article of clothing;

a locator ball assembly, which includes a ball and a stud radially projecting from the ball, the stud being anchorable to a rear face of the buttstock such that the stud projects rearward from the buttstock opposite a firing direction and the ball is spaced away from the buttstock, said ball slidable up the approach ramp to enter the oblong socket when the shooter wearing the article of clothing with attached socket assembly raises the rifle to his shoulder.

2. The combination of claim 1, wherein said socket assembly is fabricated primarily from a structural polymeric material selected from the group consisting of thermoplastic resins and thermosetting resins.

3. The combination of claim 2, wherein said thermoplastic resins are selected from the group consisting of nylon, polycarbonate (PC), polypropylene (PP), acrylonitrile/butadiene/styrene (ABS), polyvinylchloride (PVC), and polyester (PE).

4. The combination of claim 1, wherein said socket assembly is equipped with a plurality of strap attachment slots which enable said socket assembly to be attached to said article of clothing with straps, each of which is secured to a strap attachment slot.

5. The combination of claim 1, wherein said locator ball assembly is machined from a unitary piece of metal selected from the group of metals consisting of titanium, stainless steel and alloys thereof.

6. The combination of claim 1, wherein said locator ball assembly is fabricated as a thermoplastic ball molded about a metal stud.

7. The combination of claim 6, wherein said cylindrical stud is machined from a metal selected from the group of metals consisting of titanium, stainless steel and alloys thereof.

8. The combination of claim 1, wherein the stud of the locator ball assembly has an unthreaded inner shank portion and an outer threaded screw portion that threadably engages female threads within an aperture in a rear face of the rifle's buttstock.

9. A method for enhancing stabilization and aiming accuracy of a rifle having a buttstock when it is raised to a firing position by a shooter, the method comprising the steps of:

providing a locator ball assembly, which includes a ball and a stud radially projecting from the ball, the stud being anchorable to a rear face of the buttstock such that the stud projects rearward from the buttstock opposite a firing direction; and providing a socket assembly having an oblong horizontally-disposed socket, an approach ramp in communication with and positioned below the oblong socket, a wall surrounding upper and side portions of the oblong socket and side edges of the approach ramp, the approach ramp having an upper end immediately below the oblong socket and a lower end below the upper end, the lower end including a means for fastening the lower end of the approach ramp to an article of clothing; and positioning and attaching said socket assembly to a front shoulder portion of an article of clothing worn by a shooter, said spherical ball sliding up the approach ramp and entering the oblong socket when the shooter raises the rifle to firing position.

10. The method of claim 9, which further comprises the step of fabricating said socket assembly primarily from a structural polymeric material selected from the group consisting of thermoplastic resins and thermosetting resins.

11. The method of claim 10, which further comprises the step of selecting said thermoplastic resins from the group consisting of nylon, polycarbonate (PC), polypropylene (PP), acrylonitrile/butadiene/styrene (ABS), polyvinylchloride (PVC), and polyester (PE).

12. The method of claim 9, which further comprises the step of equipping said socket assembly with a plurality of strap attachment slots, which enable said socket assembly to be attached to said article of clothing with straps, each of which is secured to a strap attachment slot.

13. The method of claim 9, which further comprises the step of machining said locator ball assembly from a unitary piece of metal selected from the group of metals consisting of titanium, stainless steel and alloys thereof.

14. The method of claim 9, which further comprises the step of fabricating the locator ball assembly as a thermoplastic ball molded about a metal stud.

15. An aiming and stabilization system comprising:

a socket assembly attachable to a front shoulder portion of an article of clothing wearable by a shooter, said socket assembly having an oblong horizontally-disposed socket, an approach ramp in communication with and positioned below the oblong socket, and a wall surrounding upper and side portions of the oblong socket and side edges of the approach ramp, the approach ramp having an upper end immediately below the oblong socket and a lower end below the upper end, the lower end including a means for fastening the lower end of the approach ramp to an article of clothing;

a locator ball assembly having a ball and a stud radially projecting from the ball, the stud being anchorable to a rear face of a rifle buttstock such that the stud projects rearward from the buttstock generally opposite a firing direction and the ball is spaced away from the buttstock, said ball slidable up the approach ramp to enter the oblong socket when the shooter wearing the article of clothing with attached socket assembly raises the rifle to his shoulder.

16. The aiming and stabilization system of claim 15, wherein said socket assembly is fabricated primarily from a structural polymeric material selected from the group consisting of thermoplastic resins and thermosetting resins.

17. The aiming and stabilization system of claim 15, wherein said socket assembly is equipped with a plurality of strap attachment slots which enable said socket assembly to be attached to said article of clothing with straps, each of which is secured to a strap attachment slot.

18. The aiming and stabilization system of claim 15, wherein said locator ball assembly is machined from a unitary piece of metal selected from the group of metals consisting of titanium, stainless steel and alloys thereof.

19. The aiming and stabilization system of claim 15, wherein said locator ball assembly is fabricated as a thermoplastic ball molded about a metal stud, said metal stud being machined from a metal selected from the group of metals consisting of titanium, stainless steel and alloys thereof.

* * * * *